US008628038B2

(12) United States Patent
Muller

(10) Patent No.: US 8,628,038 B2
(45) Date of Patent: Jan. 14, 2014

(54) METHOD AND DEVICE FOR CUTTING AND ADHESION FOR AN UNROLLING MACHINE

(75) Inventor: Bernard Muller, Drusenheim (FR)

(73) Assignee: Monomatic, Strasbourg (FR)

( * ) Notice: Subject to any disclaimer, the term of this patent is extended or adjusted under 35 U.S.C. 154(b) by 998 days.

(21) Appl. No.: 12/386,781

(22) Filed: Apr. 23, 2009

(65) Prior Publication Data

US 2010/0170978 A1 Jul. 8, 2010

(30) Foreign Application Priority Data

Apr. 24, 2008 (FR) ..... 08 52754

(51) Int. Cl.
*B65H 19/20* (2006.01)

(52) U.S. Cl.
USPC ..... 242/554.2; 242/552; 242/554

(58) Field of Classification Search
USPC ..... 242/551, 552, 554, 554.1, 554.2, 555.3, 242/555.4
See application file for complete search history.

(56) References Cited

U.S. PATENT DOCUMENTS 3,257,085 A 6/1966 Riegger
3,841,944 A * 10/1974 Harris, Jr. ..... 156/504
3,858,819 A * 1/1975 Butler, Jr. ..... 242/552
3,880,698 A 4/1975 Kawazura et al.
4,190,475 A * 2/1980 Marschke ..... 156/157
4,652,329 A * 3/1987 Focke ..... 242/555.1
4,949,910 A * 8/1990 Kleitz et al. ..... 242/552
5,033,688 A * 7/1991 Georgitsis et al. ..... 242/555.1
5,669,998 A * 9/1997 Ward et al. ..... 242/552
5,679,195 A * 10/1997 O'Dwyer et al. ..... 242/554.6
5,975,457 A * 11/1999 Forbes ..... 242/552
6,364,244 B1 * 4/2002 Pasquale et al. ..... 242/554.6
7,938,925 B2 * 5/2011 Cummings et al. ..... 242/551

FOREIGN PATENT DOCUMENTS

EP 1 193 200 A 4/2002
FR 2 618 769 A 2/1989
GB 1 535 676 A 12/1978

* cited by examiner

*Primary Examiner* — William A Rivera
(74) *Attorney, Agent, or Firm* — The Watson IP Group, PLC; Jovan N. Jovanovic; Vladan M. Vasiljevic

(57) ABSTRACT

The method involves preparing an end of a new band of a new bobbin (6), and fitting a gluing joint on a connection assembly (4). Another gluing joint to be transferred is mounted on the connection assembly corresponding to a bobbin (8) unrolling a completed band. The bobbin (8) is stopped, and a junction is formed by gluing the new band with a section of the completed band using connections of the connection assembly. The unrolling of the new bobbin is started. An independent claim is also included for an end-to-end cutting and gluing device for an unrolling machine.

18 Claims, 10 Drawing Sheets

METHOD AND DEVICE FOR CUTTING AND ADHESION FOR AN UNROLLING MACHINE

The present invention relates to the domain of machines for unrolling materials in sheets from spools, particularly in continuous form, in order to supply, printing presses, cutting devices, folding and gluing machines or other processing machines in particular, and has as its object a process and a device for cutting and end-to-end adhesion for an unrolling machine comprising two spool holding elements.

Among the known unrolling machines, the connection of the ending sheet of one spool with the beginning of the sheet of the following spool is generally carried out during a temporary work stoppage, with the ending sheet passing into a reserve for sheets positioned between the outlet of the unrolling machine and the processing machine located downstream.

An unrolling machine, which is essentially composed of two spool holding tower units covered in their upper portion by a bridge structure for the accommodation of a sheets accumulator and by two casings for connecting sheets upon stopping, with each one being coordinated with a spool holding unit and mounted in a mobile manner by means of translation transversely to the sheet under the bridge structure, is likewise known from FR-A 2 618 769.

The connection casings are mounted opposite to one another, each one under the bridge structure, in a transversely displaceable manner in relation to the latter, by means of horizontal slide units connected with the said structure and projecting forward in relation to the latter, and are each connected with the corresponding tower unit by means of translation in order to be able to follow all of the movements of the corresponding tower.

On the surface rotated towards the opposite casing, each casing is provided with a plate, on the one hand with a transverse slot inclined in relation to the horizontal, in which a cutting device is mounted in a displaceable manner by means of a jack or a linear motor, and, on the other hand, with several rows of air aspiration apertures or clamps, with these apertures or clamps being provided, on the one hand, on the one side of the slot and on the other hand, in parallel with the lower edge of the plate, which is, in addition, mounted along one of its horizontal sides, preferably along its lower side and swiveling on the casing, with the swiveling axis of the plate simultaneously forming the cylinder support for the return of the sheets to be unrolled.

The casings have a width greater than the greatest possible width of the sheets to be unrolled, and their plates are, on the one hand, symmetrical in relation to a vertical surface passing between the casings and, on the other hand, are each loaded on the internal surface by a device swiveling around the axis.

A simultaneous activation of the displacement device of every plate has the effect of triggering a swiveling of the said plates around their axis and of bringing about a close and new application of the central surfaces containing the transverse slots of the said plates with the interposition of the ending sheets, as well as their adhesive joint for end-to-end connection.

This unrolling machine makes it possible to execute a cut as well as a precise and new connection between final sheets with great precision, with a brief interruption of the unrolling device, requiring a backlog downstream.

The known unrolling machines, however, do not make it possible to fully meet the new requirements for production, which demand the highest speeds with a guaranteed perfect connection.

The present invention proposes a process and a device for cutting and end-to-end adhesion for an unrolling machine comprising two spool holding tower elements that make it possible to ensure a reduction of the connection time while still ensuring a perfect connection.

For this purpose, the process of cutting and end-to-end adhesion for an unrolling machine, which comprises two spool holding elements mostly covered by a bridge structure able to accommodate a sheets accumulator and two assemblies for connecting sheets upon stopping, with each one being coordinated with one spool holding element, which is the object of the invention, is characterized in that it essentially consists of preparing, as a background operation, the end of the new sheet of a new spool and of providing an adhesion joint on a corresponding connection assembly in order to then possibly place, as a background operation, a second adhesion transfer joint on the connection assembly corresponding to the spool unrolling the final sheet, and to then carry out the stopping of the spool unrolling the final sheet and to carry out the adhesion connection of the new sheet, followed by the cutting of the final sheet, by moving the connection assemblies closer together, with the unrolling of the new spool then being initiated.

The invention likewise has as its object a device for cutting and end-to-end adhesion for an unrolling machine for the implementation of this process, with this machine being essentially composed of two spool holding elements covered on their upper portion by a bridge structure that is able to accommodate a sheets accumulator and two assemblies for connecting sheets upon stopping, with each one being coordinated with a spool holding element and arranged symmetrically in relation to the unrolling axis of the sheets, which device is characterized in that each connection assembly comprises a station for the preparation and transfer of a joint, a device for holding and cutting the new sheet or the final sheet and, possibly, a means for displacement by moving the sheet connecting assemblies together and apart.

The invention will be better understood by means of the description given in the following, which relates to the preferred modes of implementation, which are provided by way of non-limitative examples and are explained by reference to the schematic diagrams appended herewith, in which.

Figure 1:
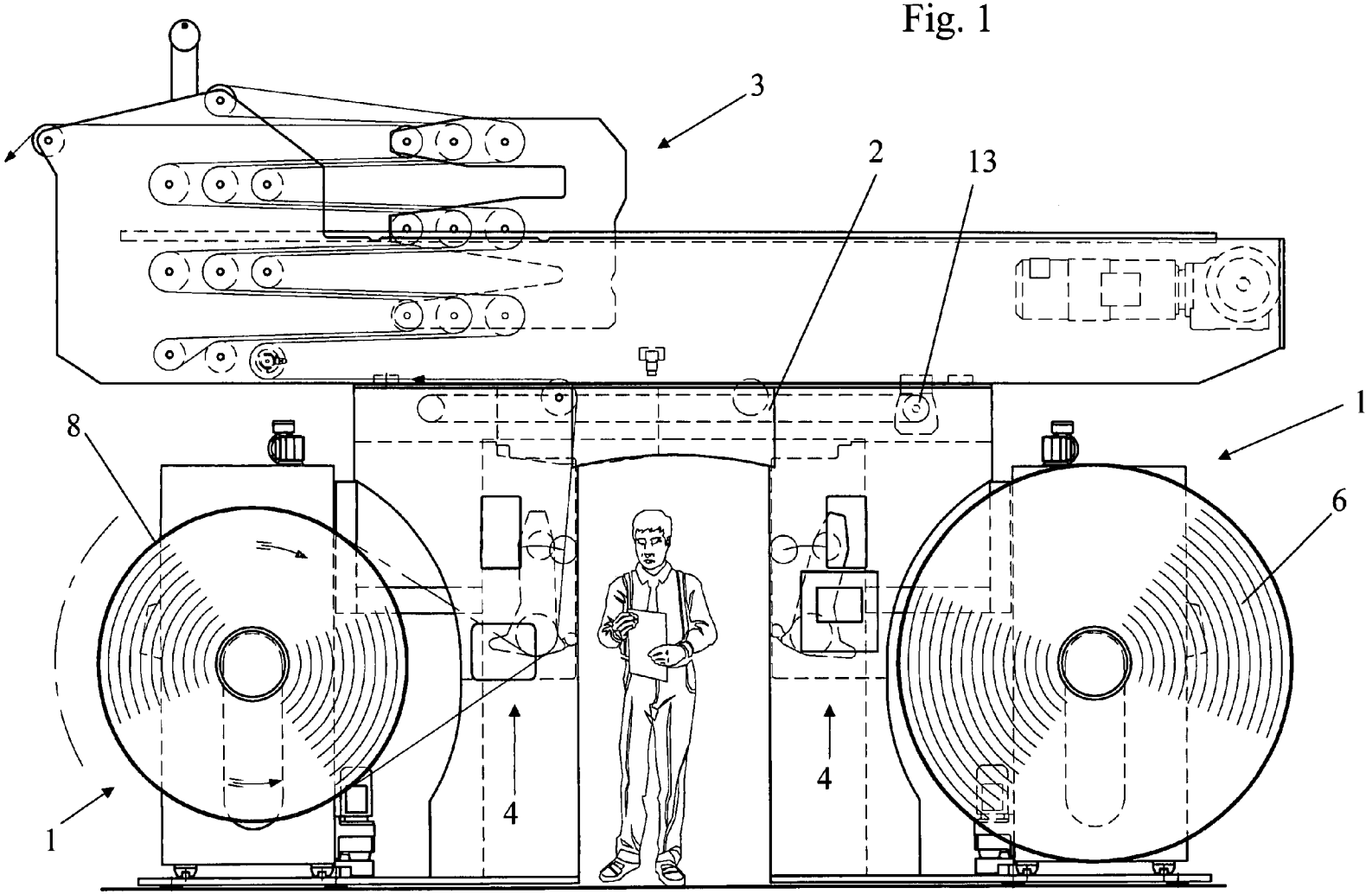
FIG. 1 is a lateral view of an unrolling machine provided with a device for the implementation of the process in accordance with the invention, in accordance with a first mode of implementation.

FIG. 1 of the appended diagrams depicts, by way of example, an unrolling machine which comprises two spool holding elements 1 that are covered in their upper portion by a bridge structure 2 for the accommodation of a sheets accumulator 3 and by two assemblies 4 for the connection of sheets upon stopping, with each one being coordinated with a spool holding element 1. In this mode of implementation, the two spool holding elements 1 have the form of spool holding towers, and the accumulator 3 is connected with the bridge 2. The accumulator sheets 3 may likewise be arranged on one side of the machine or the other however, for reasons such as, for example, the height dimensions of the same.

Figure 2:
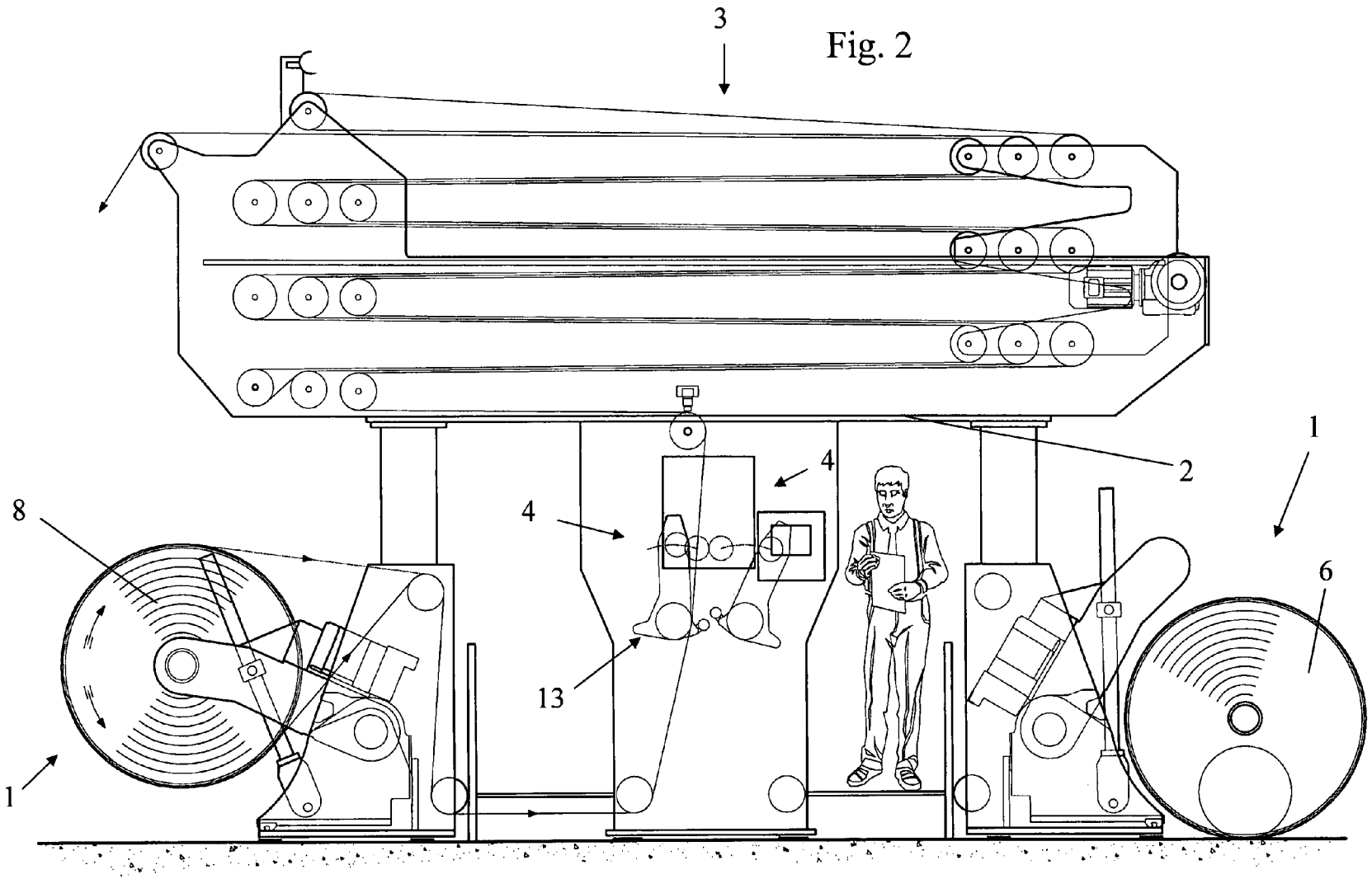
FIG. 2 is a view analogous to that of FIG. 1 of one variant of implementation of the device in accordance with the invention.
Figure 3:
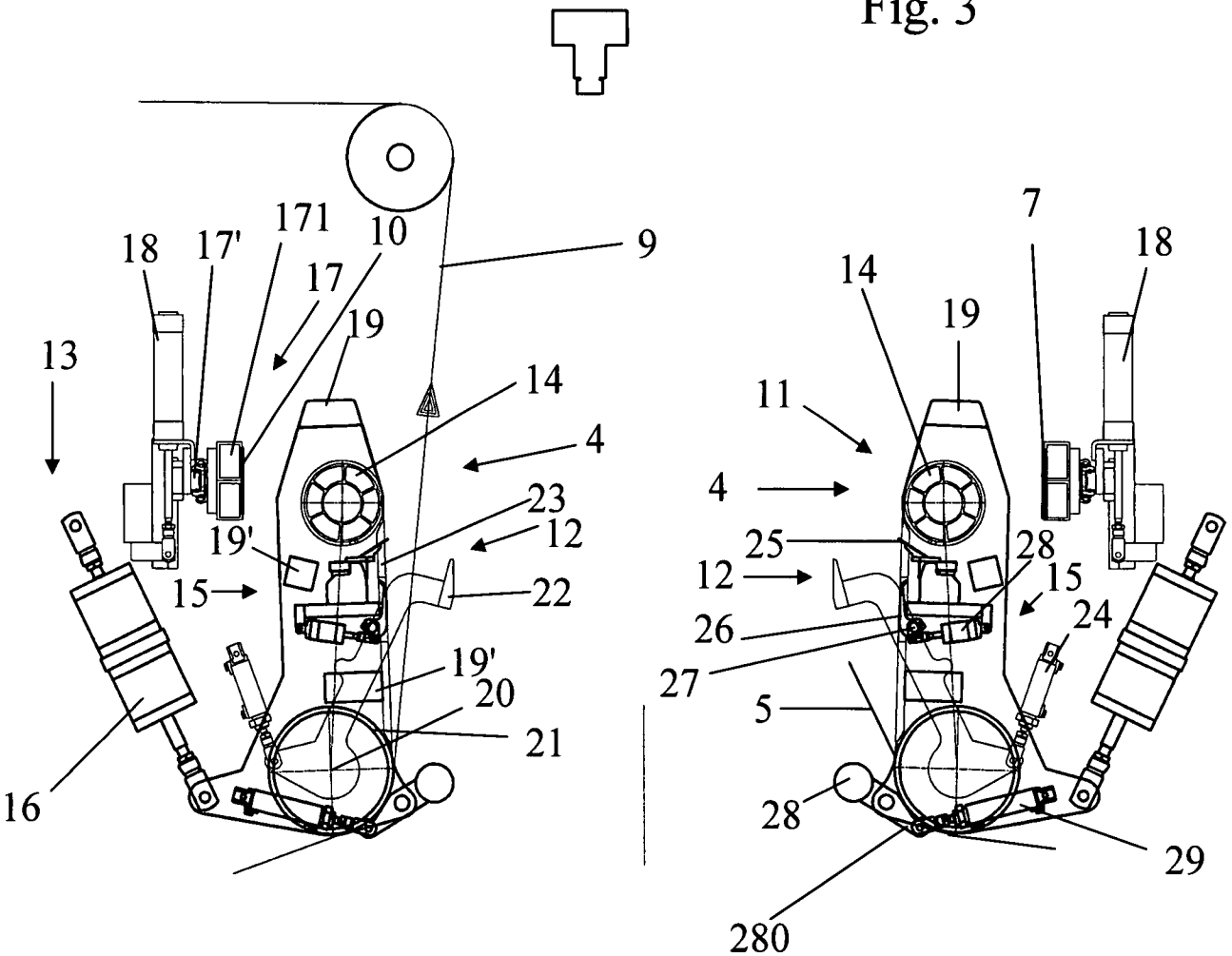
FIGS. 3 to 5 are partial lateral and cut-away views on a larger scale, depicting the connection assemblies in positions for the preparation and transfer of the joint from the side of the final sheet.
Figure 4:
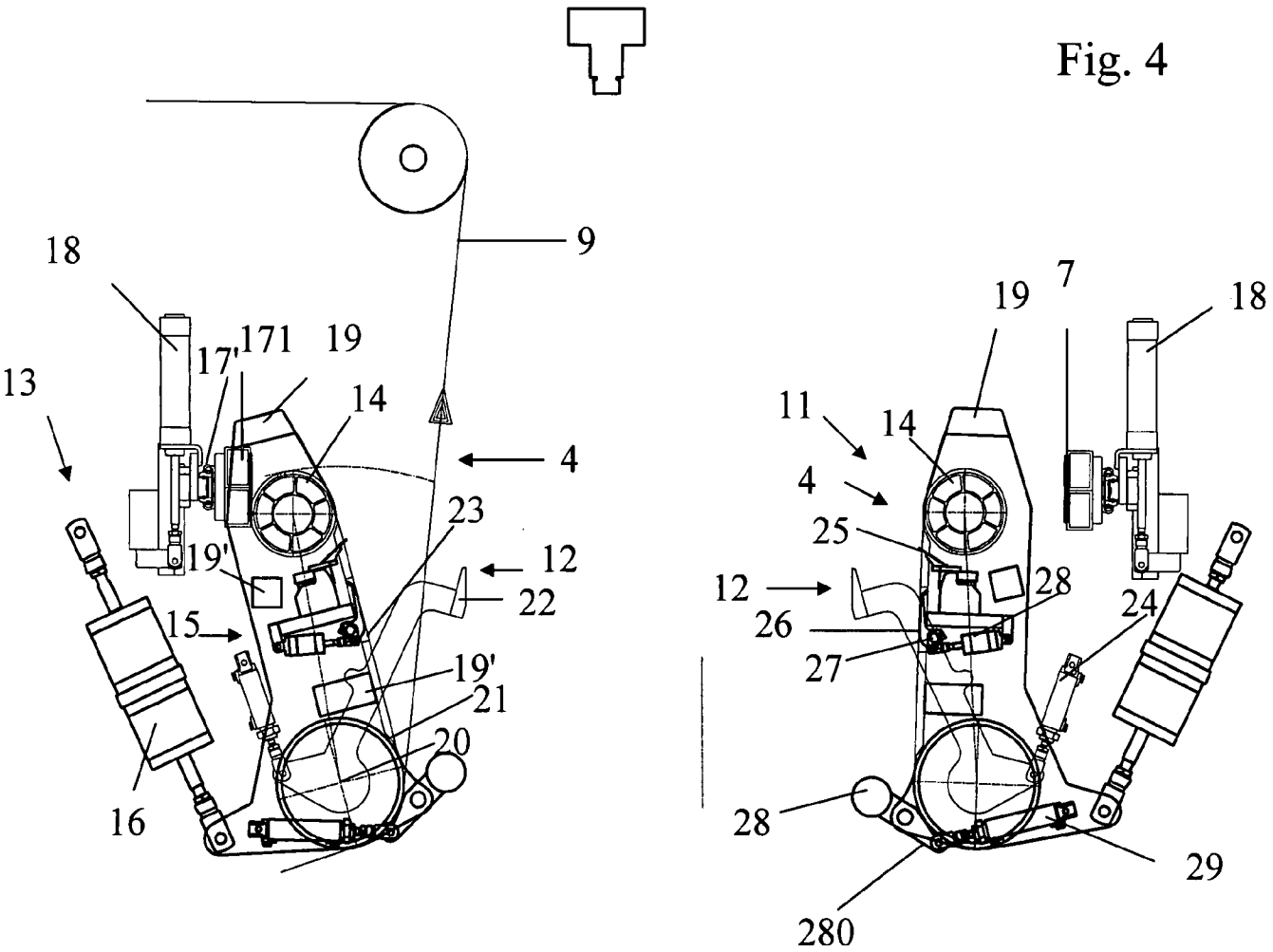
Figure 5:
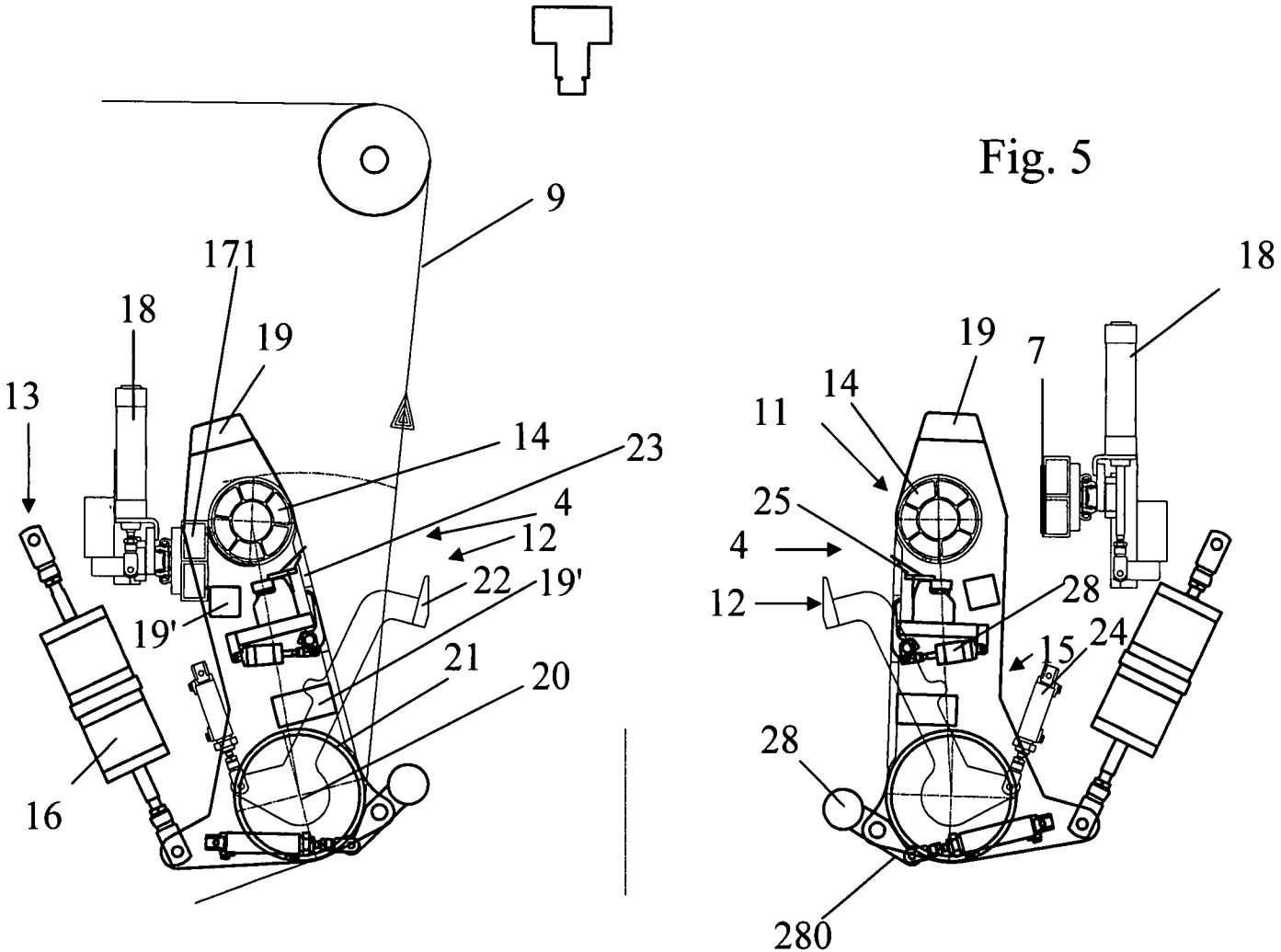
Figure 6:
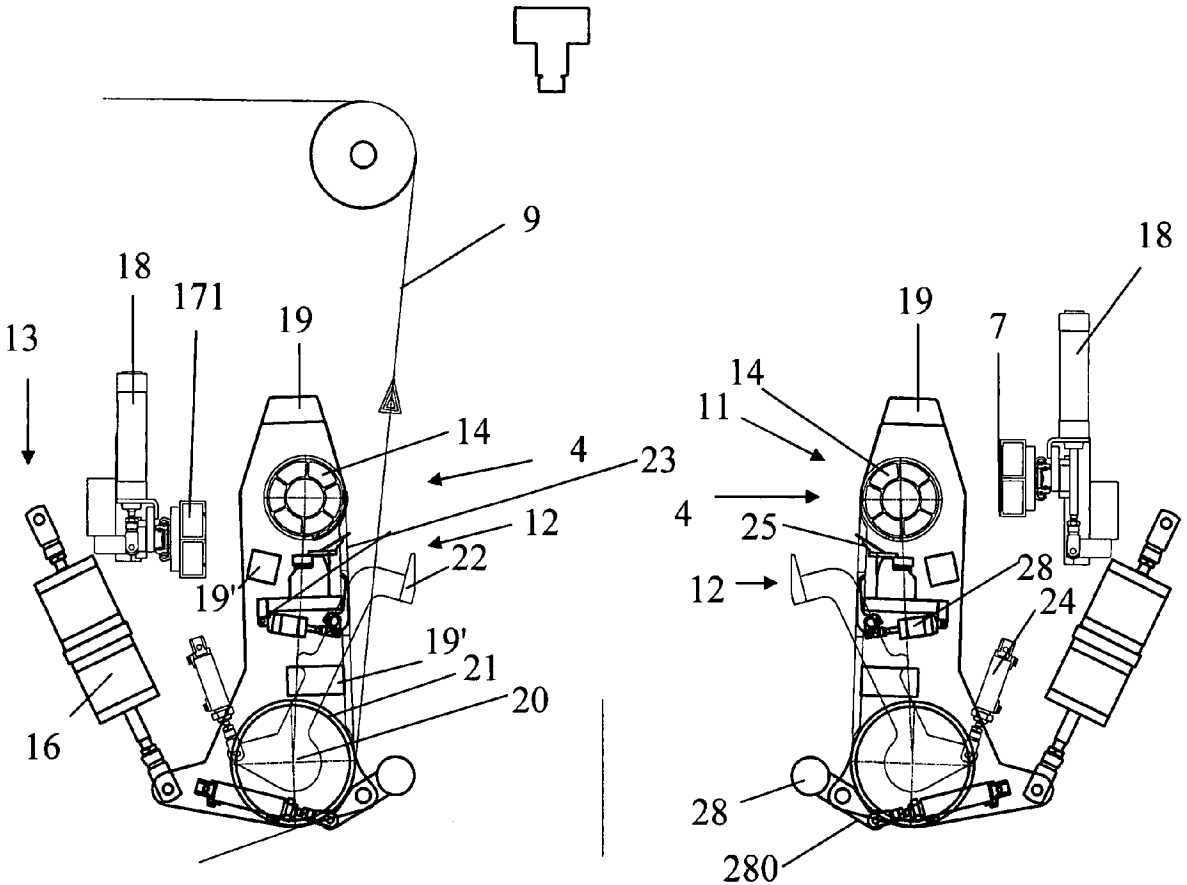
FIG. 6 is a view analogous to that of FIG. 3 depicting the beginning of the operation of preparation and transfer of the joint from the side of the new sheet.
Figure 7:
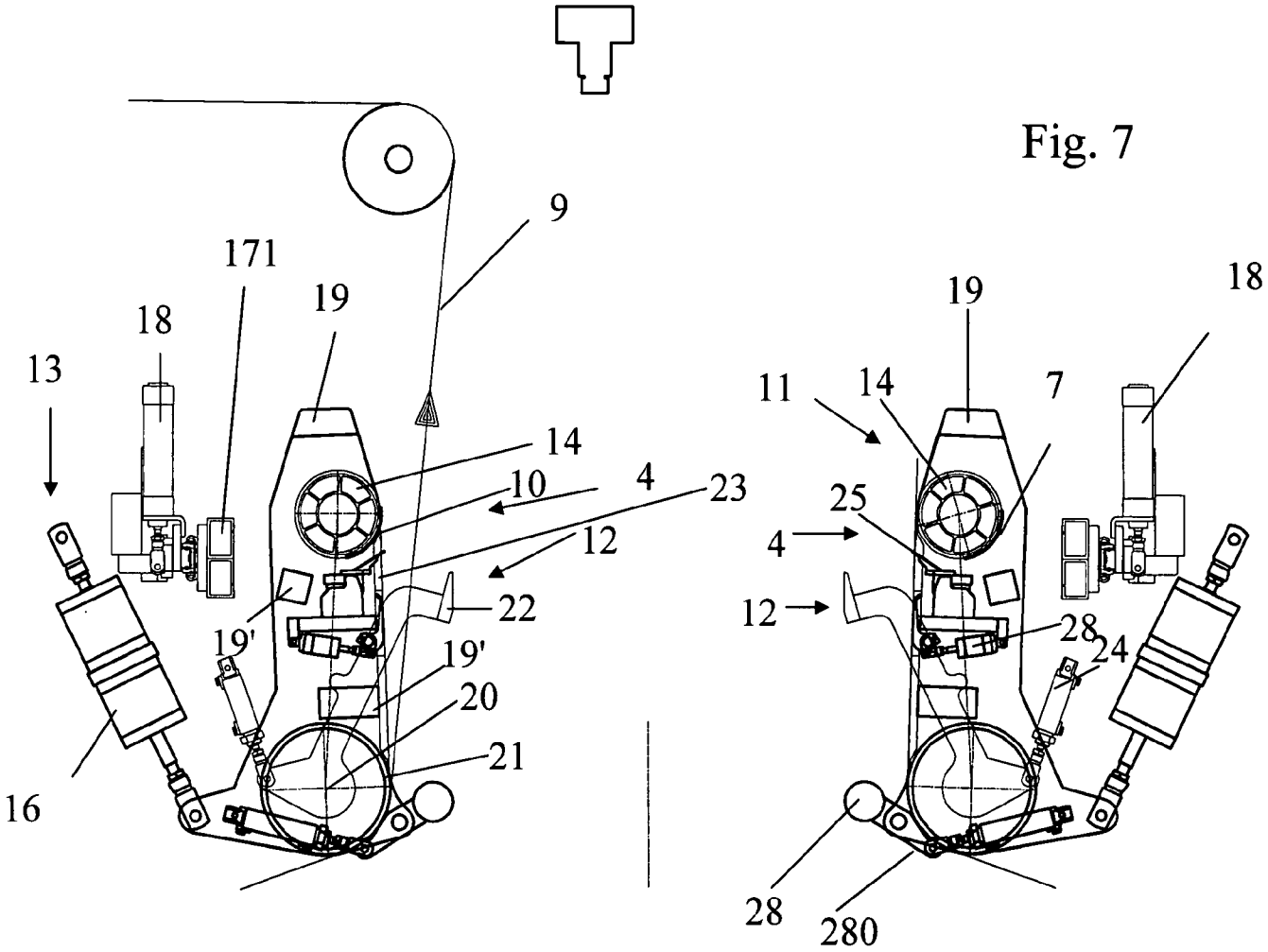
FIG. 7 is a view analogous to that of FIG. 6 depicting the threading of the start of the new sheet.

FIG. 2 of the appended diagrams depicts one variant of implementation of the unrolling machine, in which the two spool holding elements 1 have the form of supports with swiveling arms.

In accordance with the invention, the machines in accordance with FIG. 1 or in accordance with FIG. 2 implement a process for cutting and end-to-end adhesion which essentially consists of preparing, as a background operation, the end of the new sheet 5 of a new spool 6 and of providing an adhesion joint 7 on a corresponding connection assembly 4, in order to then possibly mount, as a background operation, a second transfer adhesion joint 10 on the connection assembly 4 corresponding to the spool 8 unrolling the ending sheet 9, to then stop the spool 8 from unrolling the final sheet 9 and to carry out the adhesion connection of the new sheet 5, followed by the cutting of the final sheet 9 by moving the connection assemblies 4 closer together, with the unrolling of the new spool 6 then being initiated. By means of this process, it is possible, as desired, to carry out the connection between sheets with a single joint on one single side of the ends of the sheets to be connected, or with two joints, with each side of the ends of the said sheets to be connected.

For this purpose, each connection assembly 4 of the cutting and end-to-end adhesion device for an unrolling machine in accordance with FIGS. 1 and 2 that implements this process comprises a station 11 for the preparation and transfer of a joint 7 or 10, a device 12 for holding and cutting the new sheet 5 or the final sheet 9 and, possibly, a means 13 for displacement by moving the sheet connection assemblies 4 together and apart.

Each station 11 for the preparation and transfer of a joint 7 or 10 is composed of a cylinder 14 for the reception, holding and application of a joint 7 or 10, mounted on a swiveling chassis 15 activated by means of at least one jack 16. The swiveling chassis 15 is preferably provided in the form of two lateral arms 19 that are assembled together by means of traverse units 19', as well as by a swiveling axis 20 of the said chassis 15, with this axis 20 supporting a return cylinder 21 for the new sheet 5 or the final sheet 9. The cylinder 14 is to best advantage a hollow cylinder with a depression that is provided on one portion of its surface, with perforations extending along a sheet parallel to a generator. An operator will thus be able to put the joint 7 for the end of the sheet of the new spool 6 into place by acting on the connection assembly 4 in its position of rest depicted to the right in FIGS. 1 and 2.

In the case of the implementation of the device in accordance with the invention in a machine in accordance with FIG. 2, which comprises spool holding elements 1 in the form of supports with swiveling arms, the assemblies 4 for the connection of the sheets upon stopping are advantageously positioned on a station fixed on a central chassis, and the jack or jacks 16 for the activation of the swiveling chassis 15 then form the means 13 for displacement by moving the said assemblies 4 of sheet connections together and apart. In this case, a service channel which extends between the said chassis and the supports with swiveling arms, and through which an operator can gain access, is provided on either side of the chassis for the accommodation of the assemblies 4 of sheet connections.

In the case of the implementation of a machine comprising spool holding elements 1 in the form of supports with swiveling arms, it is likewise possible, in accordance with another mode of implementation of the invention that is not depicted in the appended diagrams, to mount each of these said spool holding elements 1 on a mobile chassis that additionally supports an assembly 4 for the connection of sheets upon stopping, with the said mobile chassis being displaceable by moving together and apart by means of a mechanization device. The latter device may be a reduction gear motor or of another type.

In the case of the implementation of the device in accordance with the invention in a machine in accordance with FIG. 1, the two spool holding elements 1 have the form of spool holding towers, and the assembly 4 of the sheet connections coordinated with every spool holding tower is mounted under the bridge structure 2 in a displaceable manner by moving the other assembly 4 of sheet connections together and apart by means of the device 13 provided for displacement by moving together and apart. This device 13 may be implemented in the form of a reduction gear motor or other motorized device acting on a displacement device with reverse drive that is connected with each assembly 4 of sheet connections or, alternately, in the form of two independent actuators, each one coordinated with an assembly 4. A displacement device with reverse drive, which is not depicted in detail in the appended diagrams, may be composed, for example, of a drive chain or belt activated by a reduction gear motor or other motorized device and connected at their opposite sides to one assembly 4 for sheet connections, respectively. In one such mode of implementation, the operating area of the operator is centered between the two assemblies 4 of sheet connections, which are displaced towards one another in order to carry out the connection, and which are separated in order to make it possible to carry out the preparation operations.

In accordance with one characteristic of the invention, each station 11 for the preparation and transfer of a joint 7 or 10 is, during the implementation of a machine comprising spool holding towers, additionally provided with a table 17 mounted in a sliding manner in parallel with the assembly 4 of sheet connections, on a guide support 17' of the latter and including a casing with a depression 171. This table 17 may be displaced on the guide support 17' by means of a simple manual action, with its stopping in the extreme positions being ensured by end-of-movement stop units (not depicted) cooperating with a device for holding by means of snapping or in another form. This displacement of the table 17 may likewise be ensured by means of a jack.

The table 17 is mounted, by means of its guide support 17', on the assembly 4 of sheet connections, with the possibility for vertical displacement under the action of a jack 18. Thus, after the placement of the joint 7 or 10 on the casing 171 and the return of the table 17 into place in the assembly 4 of the sheet connections, the said table 17 may be positioned facing the perforations of the cylinder 14. This can then be displaced towards the table 17 in order to be applied against the joint 7 or 10. The aspiration is then cut in the casing 171 and simultaneously established in the cylinder 14, and the table 17 is displaced vertically by moving the cylinder 14 into rotation and moving the joint 7 or 10 forward to the corresponding longitudinal casing of the said cylinder 14.

It is likewise possible, in accordance with one variant of implementation of the invention that is not depicted in the appended diagrams, to construct the front surface of the table 17 from a flexible material mounted with the possibility for sliding on the casing forming the said table 17. It is then sufficient to simply apply the cylinder 14 against the front surface of the table 17 by force, which table will then bend in order to fit the joint 7 or 10 to the said cylinder 14. It will of course be suitable, as was the case for the first mode of implementation, to discontinue the aspiration in the table 17 and to connect it to the cylinder 14 during this operation.

The device 12 for the holding and cutting of the new sheet 5 or of the final sheet 9 is composed to best advantage of a counterpart 22 for the application of the new sheet 5 or of the final sheet 9 against a transverse support plate 23, and of a blade 25 for transverse cutting with parallel displacement, or by means of a connection to the cylinder 14 for reception, maintenance and application of a joint 7 or 10. This counterpart 22 has the form of a bar mounted between two lateral arms extending on both sides of the lateral arms 19 of the chassis 15, and is activated by swiveling by means of at least one jack 24. Thus, during the preparation of the new sheet 5 or immediately before the cutting of the ending sheet 9, the counterpart 22 is activated by the jack or jacks 24 in such a manner as to apply the corresponding part of the sheet 5 or 9 against the transverse support plate 23 in order to support the cutting of the new sheet 5 or of the final sheet 9. As soon as this cutting is carried out, the counterpart 22 is activated by means of the moving away of the transverse support plate 23.

Figure 8:
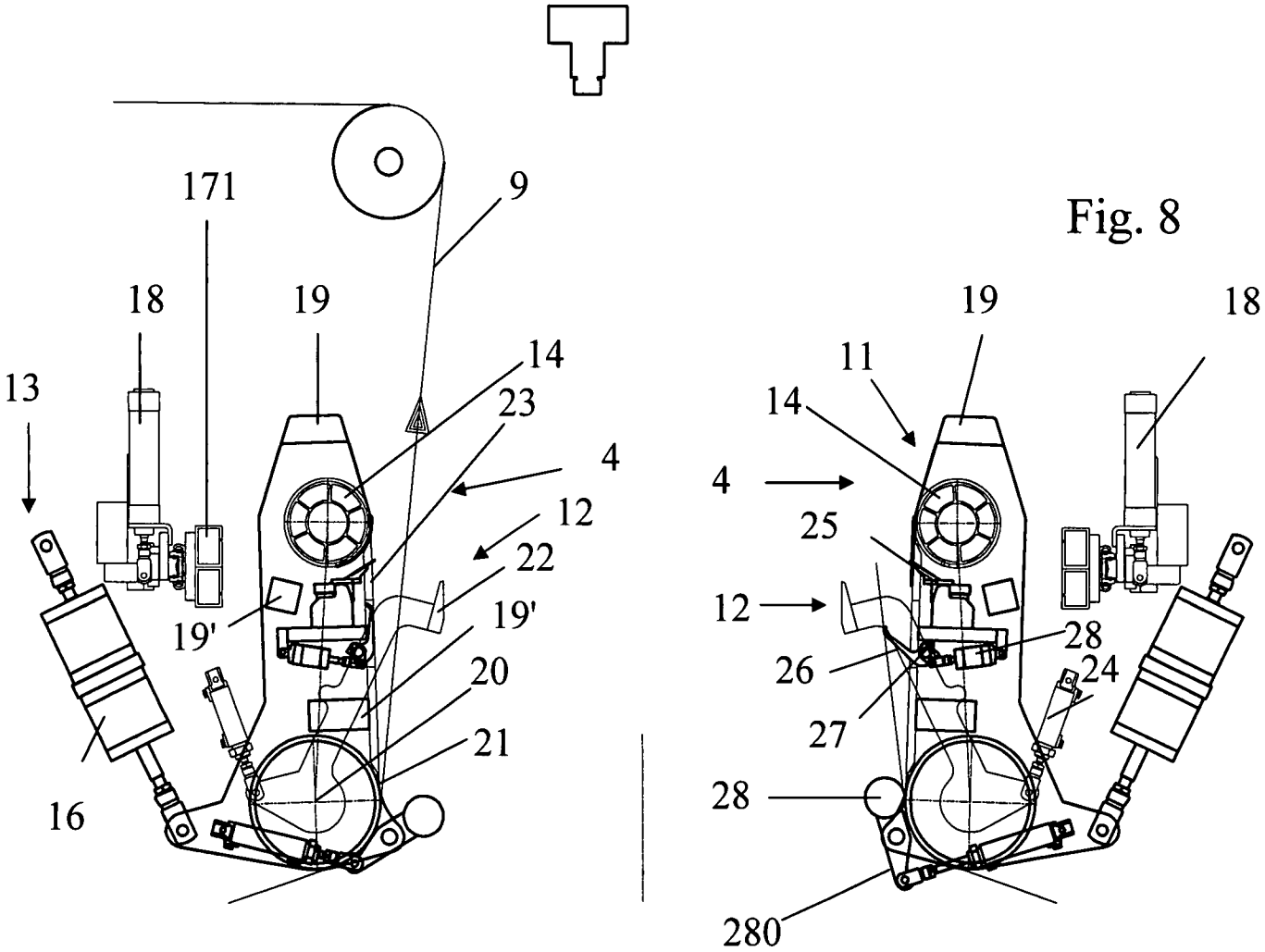
FIG. 8 is a view analogous to that of FIG. 7 depicting the connection assembly of the new sheet after preparation of the end and before the placement of the connection joint.

In the case of the implementation of relatively rigid sheets to be unrolled, it may be necessary, for the preparation of the joint of the new sheet 5, to separate the end of the new sheet 5 of the station 11 for preparation and the corresponding transfer joint 7 that has already been prepared in order to have better access to this station. For this purpose, it is provided in accordance with the invention that each connection assembly 4 includes, underneath the transverse support plate 23 and the transverse cutting blade 25, retracting units 26 that are mounted at regular intervals on a reception shaft 27 and activated by swiveling by means of at least one jack 28 connected with the chassis 15 by way of a strip. In the resting position, these retracting units 26 are retracted under the guide support of the transverse cutting blade 25 and, after the cutting of the new sheet 5, the activation of the jack or jacks 28 brings about a swiveling of the said retracting units 26 through the moving away of the end of the new sheet 5 from the station 11, as depicted in FIG. 8.

In accordance with another characteristic of the invention that is not depicted in the appended diagrams, each connection assembly 4 may be additionally provided with supplementary holding means extending under the level of the retracting units 26, such as, for example, in the form of a supplementary aspiration device extending immediately under the said retracting units 26. Thus, after cutting the end of the new sheet 5, the end of the latter may be extended, with the rest of the sheet being maintained on the said supplementary holding means.

In addition, every chassis 15 is provided, close to its return cylinder 21, with a low clamp 28 consisting of a fixed roller pivot-mounted on the chassis 15 by means of an arm 280 and activated by swiveling by at least one jack 29. This low clamp 28 is intended to hold the new sheet 5 during its preparation.

The preparation of the end of the new sheet 5 of a new spool 6, as a background operation, consists of manually threading of the new sheet 5 through a passage between the return cylinder 21 of the swiveling chassis 15 and the low clamp 28, then between the counterpart 22 for the application of the new sheet 5 and the transverse support plate 23 of the device 12 for the maintenance and cutting of the new sheet 5, in order to then close the low clamp 28 on the new sheet 5 through the swiveling of the fixed roller that comprises it against the return cylinder 21, then closing the counterpart 22 on the transverse support plate 23 of the device 12 for the holding and cutting of the new sheet 5 and cutting the end of the new sheet 5 by means of the transverse cutting blade 25.

After cutting the end of the new sheet 5, the counterpart 22 is swiveled in the direction of its opening in such a manner as to release the cut end, and the retracting units 26 are activated in such a manner that they remove the said end of the device 12 for holding and cutting.

The adhesion joint 7, as well as possibly the adhesion joint 10, are mounted, as a background operation, on the corresponding cylinder 14 for the reception, holding and application of a joint 7 and/or 10 through a previous application on the table 17, which is displaced projecting towards the exterior of the connection assembly 4, with this table 17 then being moved back into position in the said connection assembly 4 in order to be displaced in front of the cylinder 14 for the reception, holding and application of a joint 7 and/or 10, which is then swiveled in the direction of the table 17, and the latter is displaced vertically by entraining the cylinder 14 into rotation, with the depression being cut in the table 17 and connected in the cylinder 14 at the same time. An application of the joint 7 and/or of the joint 10 to the corresponding cylinder 14 then follows.

In the case of an implementation of an unrolling machine of the type depicted in FIG. 2—that is to say, one comprising spool holding elements 1 in the form of supports with swiveling arms—the threading of the new sheet 5 is carried out in a manner identical to that described in regard to a machine comprising spool holding towers. However, the placement of the joint 7 and/or 10 on the cylinder 14 for the reception, holding and application of the said joint 7 and/or 10 may be carried out directly by tipping this cylinder in the direction of the operator, who is positioned between the connection assembly 4 and the corresponding spool holding element 1.

Figure 9:
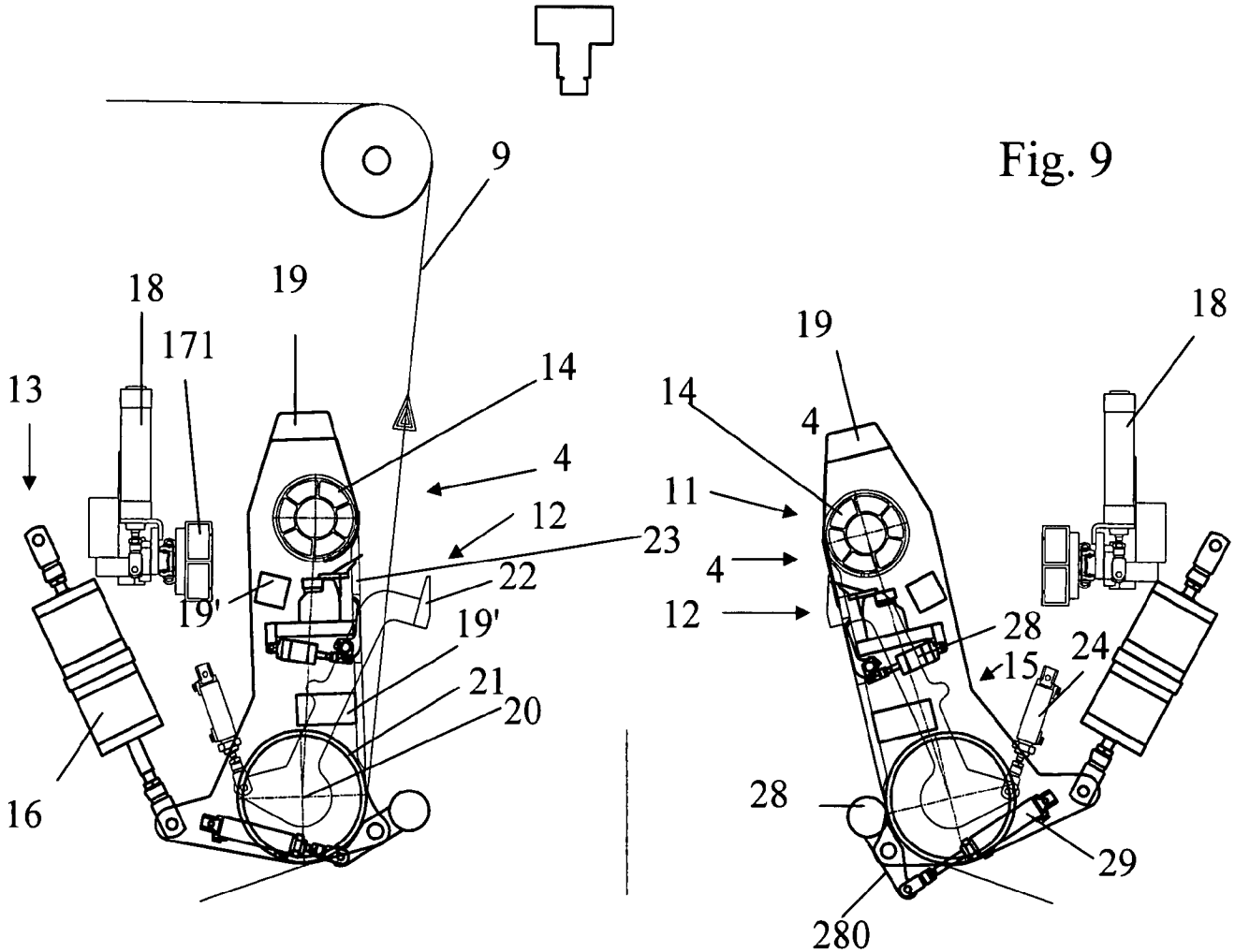
FIG. 9 is a view analogous to those of FIGS. 6 to 8 depicting the connection assembly of the new sheet in the waiting position before connection.

In the case of the implementation of two joints 7 and 10 after the previous works for the preparation of the end of the new sheet 5, as well as of the joints 7 and 10, the lower part of the joint 7 is transferred to the end of the new sheet 5 (FIG. 9), and the joint 10, which is intended to be applied to the end of the final sheet 9, are brought into position of application through the rotation of the cylinder 14 supporting it in this position (FIGS. 8 and 9).

Figure 10:
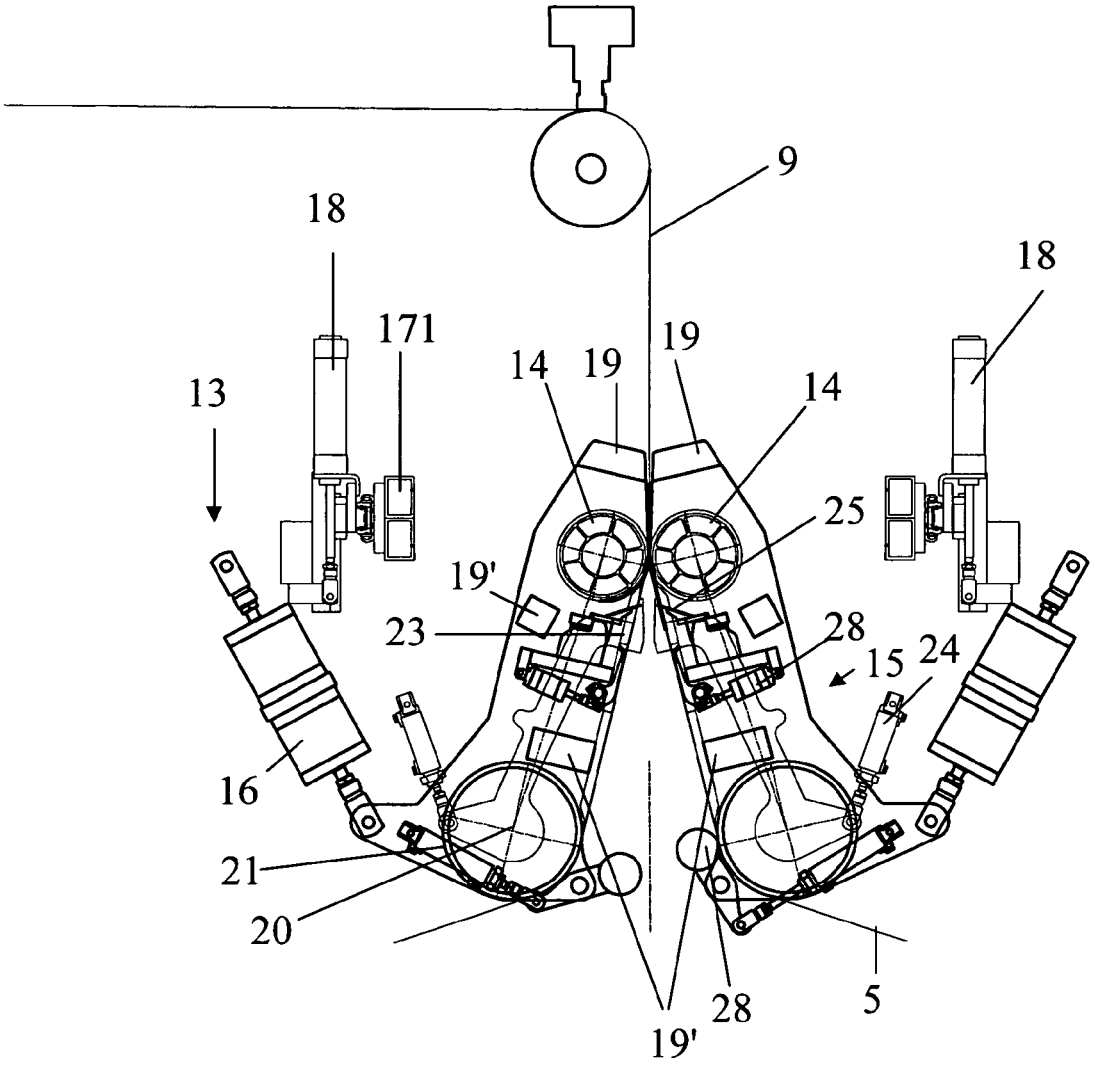
FIG. 10 depicts the device in a position for the connection of the final sheets and new sheets.

The connection assembly 4 that is coordinated with the new spool 6 is then brought into its connection position and, when the connection is to be carried out, the connection assembly 4 of the final sheet 9 is likewise brought into the connection position depicted in FIG. 10 of the appended diagrams.

For this purpose, the connection assemblies 4 may be moved closer together, as indicated above or through the displacement of these assemblies from a preparation position as depicted in FIG. 1, towards the connection position by means of the device 13, while the spool holding elements 1 have the form of spool holding towers. In the case of an implementation in accordance with FIG. 2, the spool holding elements 1 remain fixed, and the two connection assemblies 4 are arranged to best advantage with a fixed station on a central chassis. The moving of the connection elements 4 closer together for the connection between the final sheet and the new sheet then simply consists of swiveling the chassis 15 of each assembly 4 around its swiveling axis 20. In the two cases in the figures, the final sheet 9 is stopped only when the connection elements 4 apply the joints 7 and 10 to the final sheet 9 and the new sheet 5 in order to cut the final sheet 9, and for the connection of the latter to the beginning of the new sheet 5 by means of the joints 7 and 10.

Triggering of the connection simultaneously activates, in the known manner, a stop to the unrolling of the spool 8 from unrolling the final sheet 9, with the simultaneous application, on the one hand of the upper portion of the joint 10 on the end of the final sheet 9, and on the other hand of the upper portion of the joint 7 on the end of the final sheet, followed by its cutting. Immediately after the cutting of the final sheet 9, the clamping of the new sheet 5 is discontinued, and the group composed of the final sheet 9, the joints 7 and 10, and the new sheet 5 progresses slowly between the cylinders 14 from the two connection assemblies 4, in such a manner that the application of the lower portion of the joint 10 to the end of the new sheet 5 is carried out and the new spool to be unrolled 6 is then started, in order to unroll the new sheet 5 at normal unrolling speed.

In order to permit a progressive restarting of the sheets thus connected, the cylinders 14 for the reception, holding and application of a joint 7 or 10 are advantageously provided with motor components (not depicted), which may consist of a reduction gear motor assembly for each cylinder 14.

The invention has been described in relation to an end-to-end connection using two joints. It is, however, also possible to carry out such a connection with a single joint 7 advantageously provided on the new sheet 5. In one such case of implementation, the joint 7 is placed in relation to a connection with two opposite joints in the manner described above, and the adhesion of the end of the final sheet 9 is carried out on the joint 7 in the same manner as that described above, after it has been cut.

By means of the invention, it is possible to carry out an end-to-end connection of the sheets upon stopping by ensuring a perfect adhesion of the ends of the sheets on the connection joint or joints by means of the fact that the adhesion is carried out before the cutting of the final sheet.

In addition, the connection time may be considerably reduced to such an extent that the overall yield of the installation is improved.

The invention is not, of course, limited to the modes of implementation described and depicted in the appended diagrams. Modifications continue to be possible, particularly in regard to the composition of the various elements or through the substitution of equivalent techniques, without thereby departing from the range of protection for the invention.

The invention claimed is:

1. A device for cutting and end-to-end adhesion for an unrolling machine comprising two spool holding elements (1) covered in their upper portion by a bridge structure (2) able to accommodate an accumulator (3) of sheets and two assemblies (4) for connecting sheets in an end to end fashion without overlapping upon stopping, with each one being coordinated with one spool holding element (1), characterized in that, each connection assembly (4) comprises a station (11) for the preparation and transfer of a joint (7 or 10), a device (12) for the holding and cutting of the new sheet (5) or of the ending sheet (9), respectively and, a device (13) for displacement by moving the sheet connection assemblies (4) together and apart, wherein every station (11) for the preparation and transfer of a joint (7 or 10) is composed of a reception cylinder (14) for the holding and application of a joint (7 or 10) mounted on a swiveling chassis (15) activated by at least one jack (16), wherein the swiveling chassis (15) is provided, close to a return cylinder (21), with a low clamp (28) intended to hold the new sheet (5) during its preparation.

2. A device in accordance with claim 1, characterized in that, the swiveling chassis (15) is present in the form of two lateral arms (19) that are assembled together by traverse units (19), as well as by a swiveling axis (20) of the said chassis (15), with this axis (20) supporting the return cylinder (21) for the new sheet (5) or the ending sheet (9).

3. A device in accordance with claim 1, characterized in that, the cylinder (14) is a hollow cylinder.

4. A device in accordance with claim 1, characterized in that, in the case of the implementation of spool holding elements (1) in the form of supports with swiveling arms, the assemblies (4) for connecting sheets upon stopping are arranged on a fixed station on a central chassis and the jack or jacks (16) for the activation of the swiveling chassis (15) form the device (13) for displacement by moving the said sheet connection assemblies (4) together and apart.

5. A device in accordance with claim 4, characterized in that, the device is provided on one side and the other of the chassis for the reception of the sheet connection assemblies (4) with a service channel extending between the said chassis and the supports with swiveling arms.

6. A device in accordance with claim 1, characterized in that, in the case of the implementation of spool holding elements (1) in the form of supports with swiveling arms, the said spool holding elements (1) are each mounted on a mobile support chassis in addition to an assembly (4) connecting sheets upon stopping, with the said mobile chassis being displaceable by moving them together and apart by means of a motorized device.

7. A device in accordance with claim 1, characterized in that, in the case of the implementation of spool holding elements (1) in the form of spool holding towers, the sheet connecting assembly (4) coordinated with every spool holding tower is mounted under the bridge structure (2) in a manner that is displaceable by moving the other sheet connecting assembly (4) together and apart by means of the device (13) for displacement by moving together and apart, which is implemented on the one hand in the form of a reduction gear motor acting on a means for displacement with reverse entrainment connected with every sheet connecting assembly (4) or, on the other hand, in the form of two independent activators each coordinated with one assembly (4).

8. A device in accordance with claim 7, characterized in that, an operating area of the operator is centered between the two spool holding elements (1).

9. A device in accordance with claim 1, characterized in that, every station (11) for the preparation and transfer of a joint (7 or 10) is additionally provided with a table (17) mounted in a sliding manner in parallel with the sheet connecting assembly (4), on a guide support (17) of the latter and comprising a casing with a depression (171).

10. A device in accordance with claim 9, characterized in that, the table (17) is mounted, by means of its guide support (17'), on the sheet connecting assembly (4).

11. The device in accordance with claim 10, wherein the table is structurally configured for vertical displacement under the action of a jack (18).

12. A device in accordance with claim 9, characterized in that, the front surface of the table (17) is made from a flexible material mounted on the casing forming the said table (17).

13. The device in accordance with claim 12, wherein, the front surface of the table (17) is slidably mounted on the casing forming the table (17).

14. A device in accordance with claim 1, characterized in that, the device (12) for the holding and cutting of the new sheet (5) or of the ending sheet (9) is composed of a counterpart (22) for the application of the new sheet (5) or of the ending sheet (9) against a transverse support plate (23) and of a transverse cutting blade (25) with displacement in parallel with or at an angle to the reception cylinder (14) for the holding and application of a joint (7 or 10).

15. A device in accordance with claim 14, characterized in that, the counterpart (22) has the form of a bar mounted between two lateral arms extending on one side and the other of the lateral arms (19) of the chassis (15), and is activated to swivel by at least one jack (24).

16. A device in accordance with claim 1, characterized in that, each connection assembly (4) includes, underneath the transverse support plate (23) and the transverse cutting blade (25), retracting units (26) mounted at regular intervals on a reception shaft (27) and activated by swiveling by means of at least one jack (28) solidly connected with the chassis (15) by its strip.

17. A device in accordance with claim 1, characterized in that, the low clamp (28) comprises a fixed roller mounted to swivel on the chassis (15) by means of an arm (280), and is moved to swivel by at least one jack (29).

18. A device in accordance with claim 1, characterized in that, the cylinders (14) for the reception, holding and application of a joint (7 or 10) are provided with a motorized device that may consist of one assembly reduction gear motor for every cylinder (14).

* * * * *